United States Patent [19]

Huhn et al.

[11] Patent Number: 4,996,723

[45] Date of Patent: Mar. 5, 1991

[54] DRESS HAVING VENTILATION MEANS IN THE SLEEVES, HEM AND COVERABLE VENTILATION MEANS IN THE BODICE

[76] Inventors: John Huhn, 503½ Capital Battle, Creek, Mich. 49015; George Spector, 233 Broadway, Rm. 3815, New York, N.Y. 10007

[21] Appl. No.: 527,827

[22] Filed: May 24, 1990

[51] Int. Cl.[5] ..... A41D 1/22

[52] U.S. Cl. ..... 2/105; 2/DIG. 1; 2/74

[58] Field of Search ..... 2/105, DIG. 1, 74, 106, 2/121, 122

[56] References Cited

U.S. PATENT DOCUMENTS

| | | | |
|---|---|---|---|
| 308,244 | 11/1884 | Fishel | 2/DIG. 1 |
| 317,411 | 5/1885 | Brinkmann | 2/DIG. 1 |
| 2,661,472 | 12/1953 | Miller | 2/74 |
| 3,761,962 | 10/1973 | Myers | 2/DIG. 1 |
| 4,722,099 | 2/1988 | Kratz | 2/DIG. 1 |
| 4,804,351 | 2/1989 | Raml et al. | 2/DIG. 1 |

*Primary Examiner*—Werner H. Schroeder
*Assistant Examiner*—Gloria Hale

[57] ABSTRACT

A solar look dress is provided and consists of regular cloth material forming a skirt, lower bodice and cuffs of the sleeves. A netting material is for forming a hem, upper bodice and the sleeves to permit ventilation of air therethrough thus affording comfort to a wearer of the dress particularly during warm periods of the year.

5 Claims, 1 Drawing Sheet

DRESS HAVING VENTILATION MEANS IN THE SLEEVES, HEM AND COVERABLE VENTILATION MEANS IN THE BODICE

BACKGROUND OF THE INVENTION

The instant invention relates generally to wearing apparel and more specifically it relates to a solar look dress which provides ventilation of air through the dress.

There are available various conventional wearing apparel which do not provide the novel improvements of the invention herein disclosed.

SUMMARY OF THE INVENTION

A primary object of the present invention is to provide a solar look dress that will overcome the shortcomings of the prior art devices.

Another object is to provide a solar look dress in which a portion of the dress contains netting material to permit ventilation of air through the dress thus affording comfort to the wearer particularly during warm periods of the year.

An additional object is to provide a solar look dress that is both comfortable and esthetically attractive.

A further object is to provide a solar look dress that is simple and easy to use.

A still further object is to provide a solar look dress that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
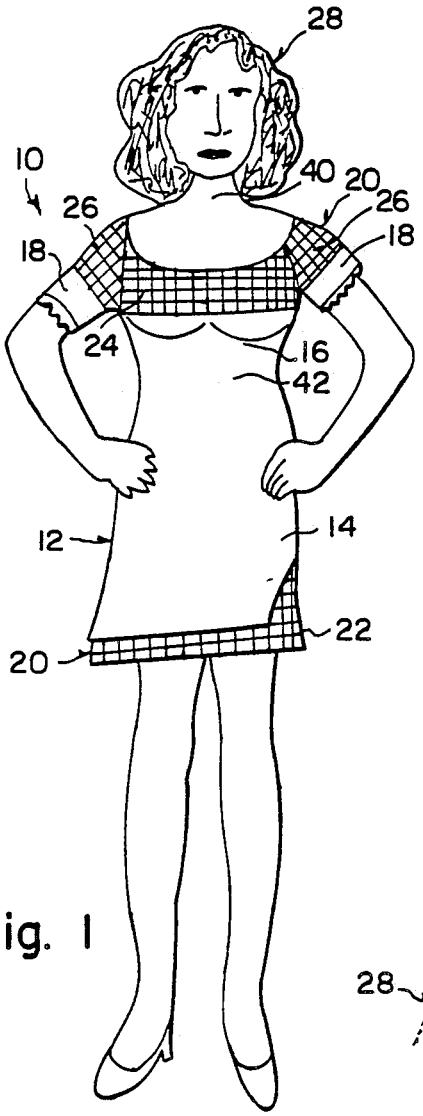
FIG. 1 is a front view of the invention worn by a woman.
Figure 2:
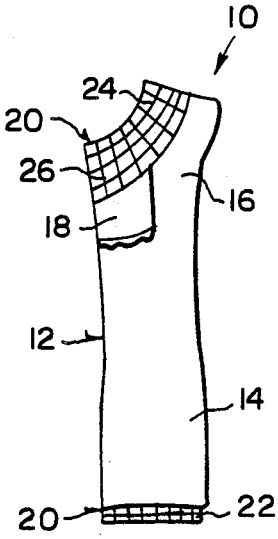
FIG. 2 is a side view of the invention.

Turning now descriptively to the drawings, in which similar reference characters denote similar elements throughout the several views, FIGS. 1 and 2 illustrate a solar look dress 10 consisting of regular cloth material 12 forming a skirt 14, lower bodice 16 and sleeve cuffs 18. Netting material 20 is for forming a hem 22, upper bodice 24 and the sleeves 26 to permit ventilation of air therethrough thus affording comfort to a wearer 28 of the dress 10 particularly during warm periods of the year.

Figure 3:
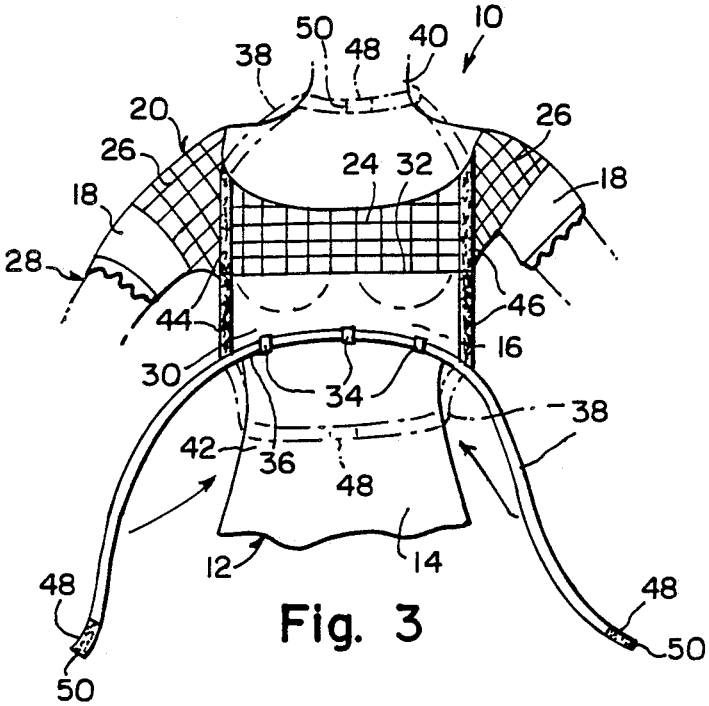
FIG. 3 is a front view of a modification in which a front flap can be worn up or down in which the elongated belt can be worn around the waist when the flap is down and around the neck when the flap is up.
Figure 4:
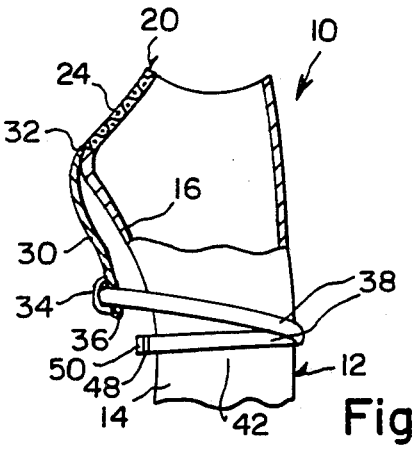
FIG. 4 is a side view of FIG. 3, with parts broken away showing the front flap down and the elongated belt wrapped around the waist to secure the flap.

FIGS. 3 and 4 show the regular cloth material 12 forming a front flap 30 which is at the juncture 32 of the lower bodice with the upper bodice 24. The front flap 30 can be removably secured in an up position to cover the netting material 20 of the upper bodice 24 during cooler periods of the year and in a down position to expose the netting material 20 of the upper bodice 24 during warmer periods of the year.

A plurality of loops 34 are along the free edge 36 of the front flap 30 and an elongated belt 38 extends through the loops 34. When the front flap 30 is in the up position the elongated belt 38 can be wrapped and worn about the neck 40 of the wearer 28 of the dress 10. When the front flap 30 is in the down position the elongated belt 38 can be wrapped and worn about the waist 42 of the wearer 28 of the dress 10.

A pair of mating hook and loop pile fabric fastener strips 44 are at each side edge 46 of the front flap 30 and the upper bodice 24 of the dress 10 to keep the front flap 30 in the up position. Another pair of mating hook and loop pile fabric fastener strips 48 are also provided. Each one is on one free end 50 of the elongated belt 38. When the elongated belt 38 is wrapped and worn about the neck 40 in one instance and the waist 42 in another instance of the wearer 28 of the dress 10, the free ends 50 of the elongated belt 38 will be removably secured together.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A solar look dress comprising:

(a) regular cloth material forming a skirt, lower bodice and cuffs; and (b) netting material forming a hem, upper bodice and the sleeves to permit ventilation of air therethrough thus affording comfort to a wearer of said dress particularly during warm periods of the year.

2. A solar look dress as recited in claim 1, further including:

(a) said regular cloth material forming a front flap which is at the juncture of the lower bodice with the upper bodice; and (b) means for removably securing said front flap in an up position to cover said netting material of the upper bodice during cooler periods of the year and in a down position to expose said netting material of the upper bodice during warmer periods of the year.

3. A solar look dress as recited in claim 2, wherein said removably securing means includes:

(a) a plurality of loops along the free edge of the said front flap; and (b) an elongated belt extending through said loops so that when said front flap is in the up position said elongated belt can be wrapped and worn about the neck of the wearer of said dress and when said front flap is in the down position said elongated belt can be wrapped and worn about the waist of the wear of said dress.

4. A solar look dress as recited in claim 3, further including a pair of mating hook and loop pile fabric fastener strips at each side edge of said front flap and the upper bodice of said dress to keep said front flap in the up position.

5. A solar look dress as recited in claim 4, further including a pair of mating hook and loop pile fabric fastener strips, each on one free end of said elongated belt so that when said elongated belt is wrapped and worn about the neck in one instance and the waist in another instance of the wearer of said dress the free ends of said elongated belt will be removably secured together.

* * * * *